US011053093B2

(12) United States Patent
Hammer et al.

(10) Patent No.: US 11,053,093 B2
(45) Date of Patent: Jul. 6, 2021

(54) WIND-UP SYSTEM AND METHOD FOR WINDING-UP A STRIP

(71) Applicant: VMI HOLLAND B.V., Epe (NL)

(72) Inventors: Jaap Hammer, Epe (NL); Pieter Cornelis Meijers, Epe (NL)

(73) Assignee: VMI HOLLAND B.V.

( * ) Notice: Subject to any disclaimer, the term of this patent is extended or adjusted under 35 U.S.C. 154(b) by 42 days.

(21) Appl. No.: 16/611,169

(22) PCT Filed: Apr. 25, 2018

(86) PCT No.: PCT/NL2018/050265
§ 371 (c)(1),
(2) Date: Nov. 5, 2019

(87) PCT Pub. No.: WO2018/208146
PCT Pub. Date: Nov. 15, 2018

(65) Prior Publication Data
US 2020/0062525 A1 Feb. 27, 2020

(30) Foreign Application Priority Data
May 10, 2017 (NL) ..... 2018889

(51) Int. Cl.
*B65H 18/10* (2006.01)
*B65H 19/22* (2006.01)

(52) U.S. Cl.
CPC ..... *B65H 19/2207* (2013.01); *B65H 18/10* (2013.01); *B65H 2301/4127* (2013.01);
(Continued)

(58) Field of Classification Search
CPC ..... B65H 18/10; B65H 19/2207; B65H 2301/4127; B65H 2301/414324; B65H 2301/4432; B65H 2801/93
See application file for complete search history.

(56) References Cited

U.S. PATENT DOCUMENTS 4,489,900 A 12/1984 Morizzo ..... 242/56 R
4,951,892 A * 8/1990 Chaplin ..... B29D 30/3007 156/395
(Continued)

FOREIGN PATENT DOCUMENTS

CN 102656107 9/2012 ..... B65H 23/195
CN 103359518 4/2017 ..... B65H 19/28
(Continued)

OTHER PUBLICATIONS

Decision to Grant issued in corresponding Japanese Patent Appln. Serial No. 2019-502092, dated Oct. 23, 2020, with English translation, 5 pages.
(Continued)

*Primary Examiner* — Sang K Kim
(74) *Attorney, Agent, or Firm* — Hayes Soloway P.C.

(57) ABSTRACT

Disclosed is a wind-up system and a method for winding-up a strip. The wind-up system includes a first work station and a first supply member for supplying the strip to said first work station. The first work station includes a first collection area for holding a first collection reel to collect and wind-up the strip; a first liner area for holding a first liner reel to unwind a liner, and a first guide area extending from the first liner area into the first collection area, wherein the unwound liner is unwound from the first liner reel through the first guide area onto the first collection reel. The wind-up system further includes a pick-and-place member for picking-up a leading end from the first supply member and for placing the picked-up leading end of the strip onto the liner within the first guide area.

35 Claims, 12 Drawing Sheets

(52) U.S. Cl.
CPC ..... *B65H 2301/414324* (2013.01); *B65H 2301/44332* (2013.01); *B65H 2801/93* (2013.01)

(56) References Cited

U.S. PATENT DOCUMENTS

| | | | | |
|---|---|---|---|---|
| 5,282,584 | A * | 2/1994 | Yano | B65H 19/2207 242/530.2 |
| 6,719,236 | B1 * | 4/2004 | Douglas | B29D 30/0016 242/530.2 |
| 9,102,490 | B2 | 8/2015 | Niwa et al. | B65H 19/26 |
| 2003/0173449 | A1 | 9/2003 | Gay et al. | 242/531.1 |
| 2012/0248651 | A1 | 10/2012 | Conti et al. | 264/299 |
| 2014/0174637 | A1 | 6/2014 | Chevaux | B29D 30/00 |
| 2015/0122096 | A1 | 5/2015 | Kim | B29D 30/46 |

FOREIGN PATENT DOCUMENTS

| | | | |
|---|---|---|---|
| DE | 202014101081 | 3/2014 | B65H 18/00 |
| EP | 2871049 | 5/2015 | B29D 30/46 |
| JP | 5-322 | 1/1993 | B21C 47/34 |
| JP | 7-100531 | 4/1995 | B21C 47/00 |
| JP | 2014-512992 | 5/2014 | B29D 30/60 |
| JP | 2016-531449 | 10/2016 | H05K 13/02 |
| JP | 2016-215584 | 12/2016 | B29D 30/30 |
| KR | 101357273 | 1/2014 | B65H 19/26 |
| WO | WO2011073795 | 6/2011 | B65H 23/195 |
| WO | 2015/040079 | 3/2015 | H05K 13/02 |

OTHER PUBLICATIONS

Chinese Official Action issued in corresponding Chinese Patent Appln. Serial No. 201880030492.5, dated Jan. 27, 2021, with English translation, 8 pages.
International Preliminary Report on Patentability issued in application No. PCT/NL2018/050265, dated Nov. 12, 2019 (7 pgs).
International Search Report and Written Opinion issued in application No. PCT/NL2018/050265, dated Jul. 12, 2018 (10 pgs).
First Office Action issued in corresponding Japanese Patent Appln. Serial No. 2019-502092, dated Apr. 14, 2020, with English translation, 6 pages.

* cited by examiner

WIND-UP SYSTEM AND METHOD FOR WINDING-UP A STRIP

BACKGROUND

The invention relates to a wind-up system and method for winding-up a strip.

US 2012/0248651 A1 discloses a method and apparatus for controlling the winding of an elongated element onto a collection reel with the interposition of a service fabric. The apparatus features a first work station and a second work station substantially identical to the first work station and arranged downstream of said first work station. The apparatus is arranged for feeding the elongated element alternately on the collection reel of the first work station or on the collection reel of the second work station, allowing the collection and the discharge of a collection reel while the elongated element and the service fabric are wound on the other collection reel. The apparatus is provided with a feeding device having a first conveyor belt close to the collection reel and a second conveyor belt operatively arranged between the first conveyor belt and the collection reel. The second conveyor belt may be moved towards and/or from said collection reel automatically, with clear advantages from the operating point of view.

It has been found that elongated elements, in particular strips for use in breaker plies for tires, behave unpredictably on the conveyors of the feeding device. Moreover, when feeding a length of the elongated element towards the collection reel, the elongated element has a free portion that is about to be deposited from the second conveyor onto the collection reel. Because the specifications of the collection reel are typically in the clients' domain, it may be difficult to accurately deposit the elongated element onto collection reels of different specifications. The process may have to be interrupted temporarily to allow an operator to correctly position the free portion of the elongated element. This is a potentially hazardous operation, in particular when the elongated element has sharp edges, e.g. due to steel wires.

US 2015/0122096 A1, KR 10-1357273 B1 and DE 202014101081 U1 all disclose similar apparatuses featuring conveyors and elongated elements which have a portion suspended freely from said conveyors prior to the deposition on the collection reel.

It is an object of the present invention to provide a wind-up system and method for winding-up a strip, wherein at least one of the aforementioned drawbacks can be reduced.

SUMMARY OF THE INVENTION

According to a first aspect, the invention provides a wind-up system for winding-up a strip, wherein the wind-up system comprises a first work station and a first supply member for supplying the strip to said first work station in a supply direction, wherein the first work station comprises:

a first collection area for holding a first collection reel that is arranged to collect and wind-up the strip over a plurality of windings;

a first liner area for holding a first liner reel that is arranged to unwind a liner; and a first guide area extending from the first liner area into the first collection area, wherein the unwound liner is arranged to be unwound from the first liner reel at the first liner area through the first guide area onto the first collection reel at the first collection area;

wherein the wind-up system further comprises a pick-and-place member for picking-up a leading end of the strip from the first supply member at a pick-up position and for placing the picked-up leading end of the strip onto the liner at a placement position within the first guide area.

By picking and placing, the position of the leading end of the strip can be controlled accurately at the pick-up position, the placement position and therein between. The need for manual repositioning of the leading end onto the liner can be eliminated. Hence, the process of picking-up and placing the leading end can be fully automated and does no longer require intervention by an operator.

In a preferred embodiment the wind-up system comprises a manipulator for moving the pick-and-place member from the pick-up position above the first supply member into the placement position at the unwound liner within the first guide area. The manipulator can automate the movement of the pick-and-place member from the pick-up position into the placement position, thereby again eliminating the need for intervention by an operator.

In a further embodiment thereof the pick-and-place member comprises a head and one or more retaining elements for retaining the leading end of the strip to the head from the moment it has been picked-up at least until the leading end of the strip has been placed onto the liner. Hence, the leading end can be handled in a manner in which it is never let go during the transfer from the pick-up position up to the placement position.

In a further embodiment thereof the strip comprises metal, wherein the one or more retaining elements comprises at least one magnet. A strip comprising metal, e.g. a breaker ply, can be easily and securely retained to the head with the use of the magnetic attraction generated by the magnet. Alternatively, the one or more retaining elements comprises at least one vacuum element which can be used to retain non-magnetic tire components, e.g. tire components with textile reinforcements or without reinforcements.

Preferably, the manipulator is an XY-drive. The XY-drive, e.g. an XY-gantry has two translational degrees of freedom, preferably horizontally, e.g. parallel to the supply direction, and vertical. By moving the XY-drive in both degrees of freedom at the same time, a complex motion path can be generated.

In another embodiment the pick-and-place member comprises a feed-through member for feeding the placed leading end of the strip through from the placement position within the first guide area towards and into contact with the first collection reel at the first collection area. Hence, the pick-and-place member is not only arranged for placing the picked-up leading end onto the liner at the placement position, but can also advance or feed-through said leading end towards the first collection reel. Therefore, not only the pick-up and placement, but also the feed-through until engagement of the leading end with respect to the first collection reel can be accurately controlled with the same pick-and-place member.

In an embodiment thereof the feed-through member is a feed-through conveyor. By using a conveyor-type feed-through member, the strip can be fed-through by simply driving the feed-through conveyor, without moving the pick-and-place member as a whole. Hence, the pick-and-place member can remain spaced apart from the first collection reel in the first guide area while the leading end is advanced towards and into engagement with the first collection reel.

In a further embodiment thereof the feed-through member defines a feed-through plane and is arranged for feeding the strip through in said feed-through plane, wherein the pick-and-place member comprises a deflection roller that is located downstream of the feed-through member with respect to the supply direction, wherein the deflection roller is rotatable with respect to the feed-through member about a deflection axis extending parallel to the feed-through plane and perpendicular to the supply direction, wherein the deflection roller is positionable in a deflection position in which the deflection roller at least partially intersects with the feed-through plane for deflecting the strip away from the feed-through plane. The relatively rigid strip can thus be effectively deflected towards the first work station.

In a preferred embodiment thereof, the pick-and-place member comprises an additional retaining element at or in the deflection roller. The additional retaining element can reliably retain the leading end of the strip, in particular, when said leading end is relatively long and extends well beyond the head of the pick-and-place member.

In another embodiment the pick-and-place member is provided with a tilt hinge that is arranged for connecting the pick-and-place member to the manipulator such that the pick-and-place member is tiltable with respect to the manipulator about a tilt axis to extend parallel to the strip at the pick-up position and parallel to the unwound liner at the placement position. The pick-and-place member can thus be placed in different orientations depending on the orientation of the strip to be picked-up or the orientation of the liner onto which the picked-up strip has to be placed.

In yet another embodiment the wind-up system comprises a control unit that is operationally connected to the first supply member for controlling the supply speed of the first supply member, wherein the control unit is further operationally connected to the feed-through member for feeding the strip through at a feed-through speed in the supply direction that is equal to the supply speed when picking-up the strip in the pick-up position. Hence, the pick-and-place member can pick-up the strip while being stationary with respect to the first supply member. As soon as the pick-and-place member starts to move with the picked-up strip, the feed-through speed can be reduced.

In an embodiment thereof the control unit is arranged for adjusting the feed-through speed to match a wind-up speed of the first collection reel when feeding the strip through from the placement position towards the first collection reel. Hence, stretching or compression of the strip between the pick-and-place member and the first collection reel can be prevented.

In a further embodiment thereof the first workstation comprises a first slacking area extending between the first supply member and the first guide area for guiding a slacking portion of the strip from the first supply member towards the first guide area, wherein the wind-up system is provided with a first sensor in said first slacking area for detecting the amount of slacking of the strip, wherein the control unit is arranged for lowering the feed-through speed to a speed that is lower than the supply speed at the moment that the strip is placed onto the liner and for adjusting the feed-through speed to match the wind-up speed of the first collection reel when a threshold amount of slacking is detected. By allowing the strip to slack to said threshold amount, a buffer length of the strip is generated to compensate for variations in the wind-up speed at the first collection reel, e.g. as a result of the increasing diameter of each winding.

In an embodiment the control unit is operationally connected to the pick-and-place member for releasing the strip from the pick-and-place member when the leading end has been engaged by the first collection reel. Hence, the strip can be retained by the pick-and-place member until it has been engaged by the first collection reel. This can greatly improve the accuracy of the placement and subsequent engagement of the strip.

In an alternative embodiment the manipulator comprises a robotic arm. Preferably, said manipulator has at least four degrees of freedom. In contrast to the XY-drive according to one of the previously described embodiments, the robotic arm has significantly more degrees of freedom and may thus drive more complex movements of the pick-and-place member. This alternative manipulator is preferably used in systems with more complex and/or unknown variables, such as a system in which the specifications of the collection reel and/or the liner reel are in the clients' domain.

In an embodiment thereof the wind-up system comprises a control unit that is operationally connected to the first supply member for controlling the supply speed of the first supply member, wherein the control unit is further operationally connected to the manipulator for moving the pick-and-place member at a pick-up speed in the supply direction that is equal to the supply speed when picking-up the strip in the pick-up position. Hence, the relative speed of the pick-and-place member with respect to the strip can be reduced to zero at the moment of picking-up.

In a further embodiment thereof the first work station is provided with a feed-through retainer for retaining the strip to the liner during feeding-through of said strip towards the first collection reel. Provided that the robotic arm is not provided with a feed-through member as previously described, it may be limited in guiding the leading end up to its engagement with the first collection reel. Instead, a feed-through retainer is provided at or near the liner to take-over the strip from the manipulator. After the manipulator has released the strip in the placement position, the feed-through retainer can retain the strip to the liner and prevent shifting of the strip with respect to said liner when the liner is guided, together with the strip supported thereon, towards and into engagement with the first collection reel.

Moreover, it is preferable that the control unit is operationally connected to the feed-through retainer for releasing the strip from the feed-through retainer when the leading end has been engaged by the first collection reel. The strip can be retained to the liner up to the moment that the leading end is engaged by the first collection reel, thereby increasing the accuracy of the positioning of the strip with respect to the liner up to the first collection reel.

In a further embodiment thereof the strip comprises metal, wherein the feed-through retainer is a magnet that is arranged to be located below the unwound liner at or near the placement position. A strip comprising metal, e.g. a breaker ply, can be easily retained to liner at the feed-through retainer with the use of the magnetic attraction generated by the magnet. Preferably, the magnetic attraction is strong enough to retain the strip to the liner while allowing the laminate of the liner and the strip to be fed-through towards the first collection reel.

In an embodiment thereof the pick-and-place member comprises a head and one or more retaining elements for retaining the leading end of the strip to the head at least until the leading end of the strip has been placed onto the liner, wherein the one or more retaining elements comprises at least one magnet, wherein the position of the feed-through retainer is offset with respect to the one or more retaining elements. Hence, interference of the feed-through retainer magnet and the one or more magnets in at the pick-and-place member can be prevented.

In a highly efficient embodiment of the invention, the wind-up system further comprises a second work station, wherein the second work station comprises:

a second collection area for holding a second collection reel that is arranged to collect and wind-up the strip over a plurality of windings;

a second liner area for holding a second liner reel that is arranged to unwind a liner; and a second guide area extending from the second liner area into the second collection area, wherein the unwound liner is arranged to be unwound from the second liner reel at the second liner area through the second guide area onto the second collection reel at the second collection area, wherein the pick-and-place member is arranged for picking-up the leading end of the strip from the first supply member at a pick-up position and for alternately placing the picked-up leading end of the strip onto the liner at a placement position within the first guide area of the first work station and at a placement position within the second guide area of the second work station.

When the winding of the strip on the first collection reel in the first work station has been completed, the strip can be cut-off and the new leading end can be picked-up and placed onto the liner at the second work station, to be subsequently wound on the second collection reel. In the meantime, the collection reel and the liner reel at the first work station can be replaced by new set for a subsequent winding cycle.

In an embodiment thereof the first work station and the second work station are arranged in tandem in the supply direction. Hence, switching to the second work station simply requires guiding the first strip towards the second work station behind the first work station.

In an embodiment thereof the wind-up system comprises a second supply member extending in-line with the first supply member above the first work station for receiving and guiding the strip over said first work station when the picked-up leading end of the strip is placed at a placement position within the second guide area of the second work station. The strip can thus be guided overhead the first work station, thereby effectively bypassing said first work station so that the full first collection reel can be replaced without interfering with the winding in the second work station.

In an alternative embodiment the first work station and the second work station are arranged side-by-side in a direction transverse to the supply direction. By arranging the work stations side-by-side, the wind-up system can be designed to consume less space on the factory floor and/or to be more compact.

In an embodiment thereof the first work station, the second work station or both are at an oblique angle with respect to the supply direction. In such a configuration, e.g. a Y or V configuration, the pick-and-place member can easily and/or quickly alternate between the work stations by rotating over an angle into alignment with one of the respective work stations.

In a further embodiment the wind-up system further comprises a third work station or further work stations. Said third or further work stations may for example be used to collect scrap or to collect other types of strips.

According to a second aspect, the invention provides a method for winding-up a strip with the use of the wind-up system according to any one of the preceding claims, wherein the method comprises the steps of:

unwinding the liner from the first liner reel at the first liner area through the first guide area onto the first collection reel at the first collection area;

using the pick-and-place member to pick-up a leading end of the strip from the first supply member at a pick-up position and to place the picked-up leading end of the strip onto the liner at a placement position within the first guide area.

In a preferred embodiment of the method, the leading end of the strip is retained by the pick-and-place member from the moment it has been picked-up at least until the leading end of the strip has been placed onto the liner.

The method and its embodiments relate to the practical implementation of the wind-up system according to the first aspect of the invention and thus have the same technical advantages as said wind-up system and its respective embodiments. These advantages will not be repeated hereafter.

In a further embodiment of the method, the strip is fed-through from the placement position towards the first collection reel at a feed-through speed, wherein the first workstation comprises a first slacking area extending between the first supply member and the first guide area for guiding a slacking portion of the strip from the first supply member towards the first guide area, wherein the feed-through speed lower than the supply speed at the moment that the strip is placed onto the liner and is adjusted to match the wind-up speed of the first collection reel when a threshold amount of slacking is detected.

In an embodiment thereof the strip is released from the pick-and-place member when the leading end has been engaged by the first collection reel.

In a further embodiment thereof the strip is retained to the liner by a feed-through retainer during feeding-through of said strip towards the first collection reel.

In an embodiment thereof the strip is released from the feed-through retainer when the leading end has been engaged by the first collection reel.

In another preferred embodiment of the method, the wind-up system further comprises a second work station, wherein the second work station comprises:

a second collection area for holding a second collection reel that is arranged to collect and wind-up the strip over a plurality of windings;

a second liner area for holding a second liner reel that is arranged to unwind a liner; and a second guide area extending from the second liner area into the second collection area, wherein the unwound liner is arranged to be unwound from the second liner reel at the second liner area through the second guide area onto the second collection reel at the second collection area, wherein the pick-and-place member picks-up the leading end of the strip from the first supply member at a pick-up position and alternately places the picked-up leading end of the strip onto the liner at a placement position within the first guide area of the first work station and at a placement position within the second guide area of the second work station.

The various aspects and features described and shown in the specification can be applied, individually, wherever possible. These individual aspects, in particular the aspects and features described in the attached dependent claims, can be made subject of divisional patent applications.

BRIEF DESCRIPTION OF THE DRAWINGS

The invention will be elucidated on the basis of an exemplary embodiment shown in the attached schematic drawings, in which.

DETAILED DESCRIPTION OF THE INVENTION

FIGS. 1-4 show a wind-up system 1 for winding-up a strip 91 according to a first exemplary embodiment of the invention. The strip 91 is a continuous strip or band that is stored in a plurality of windings for use later on in a tire building process. The strip 91 is preferably a reinforced strip, most preferably a metal reinforced strip, e.g. for the production of breaker plies for tires.

Figure 1:
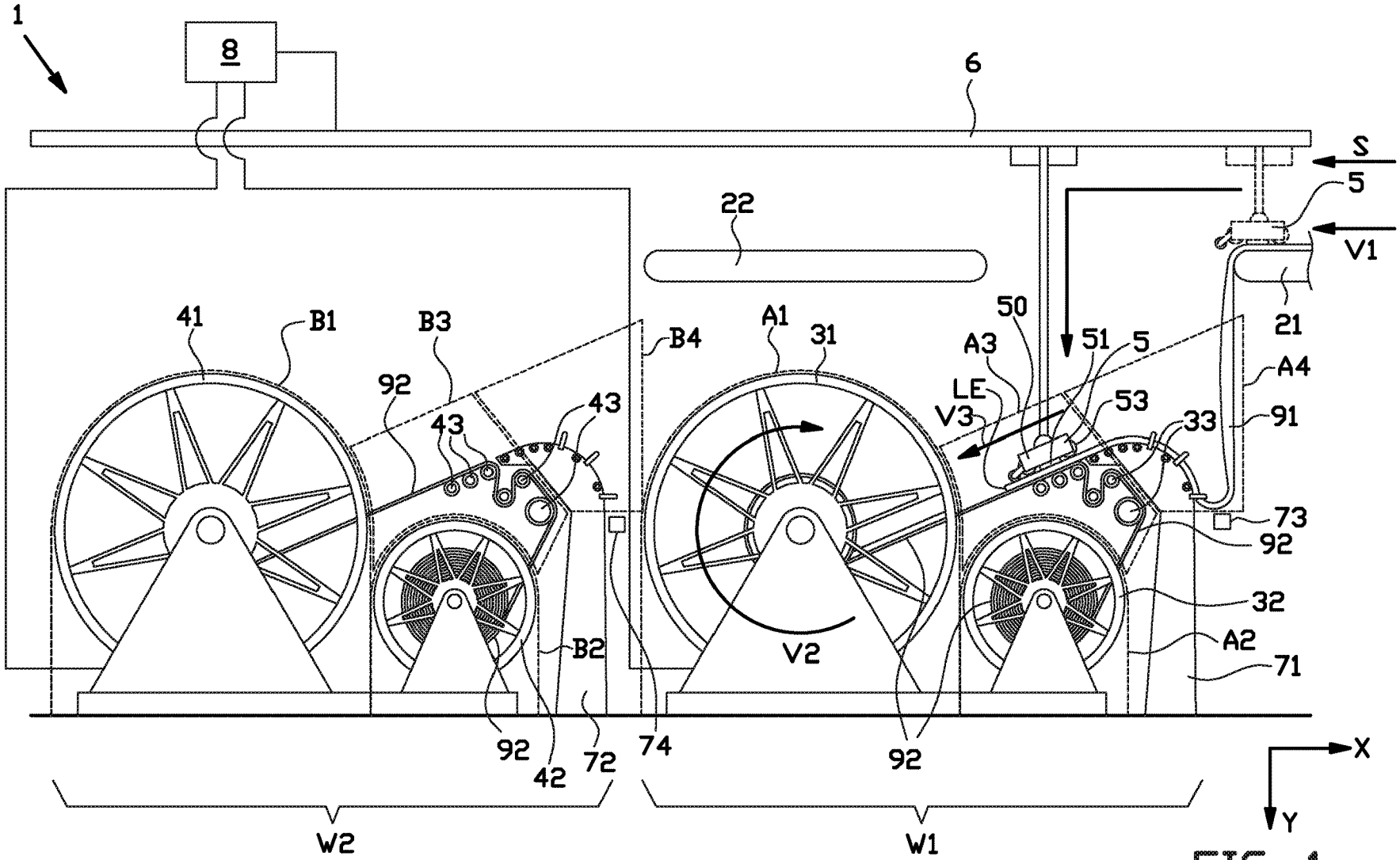
FIGS. 1 and 2 show side views of a wind-up system with a first work station and a second work station according to a first exemplary embodiment of the invention during the winding-up of a strip at the first work station and the second work station, respectively.
Figure 2:
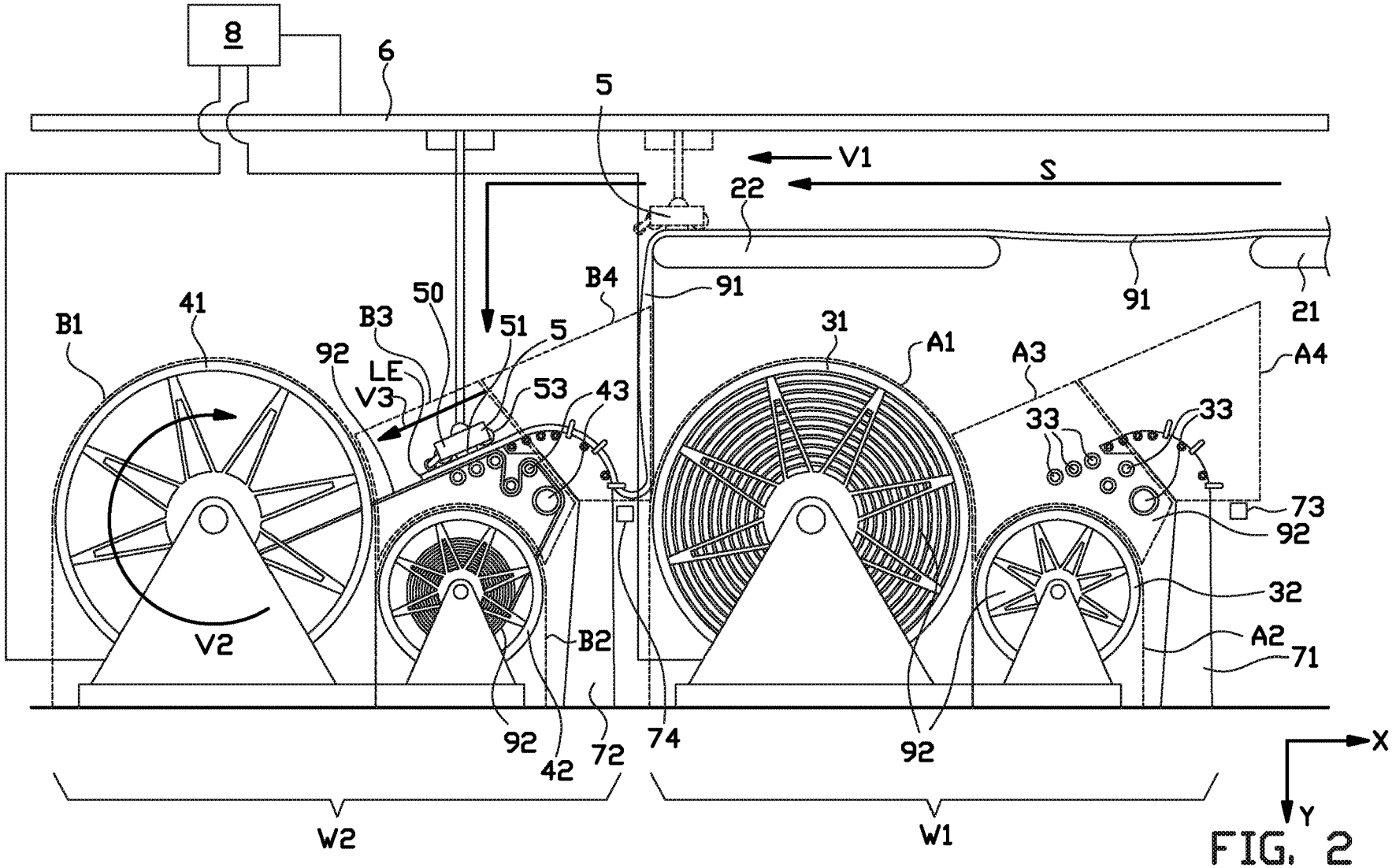
Figure 3:
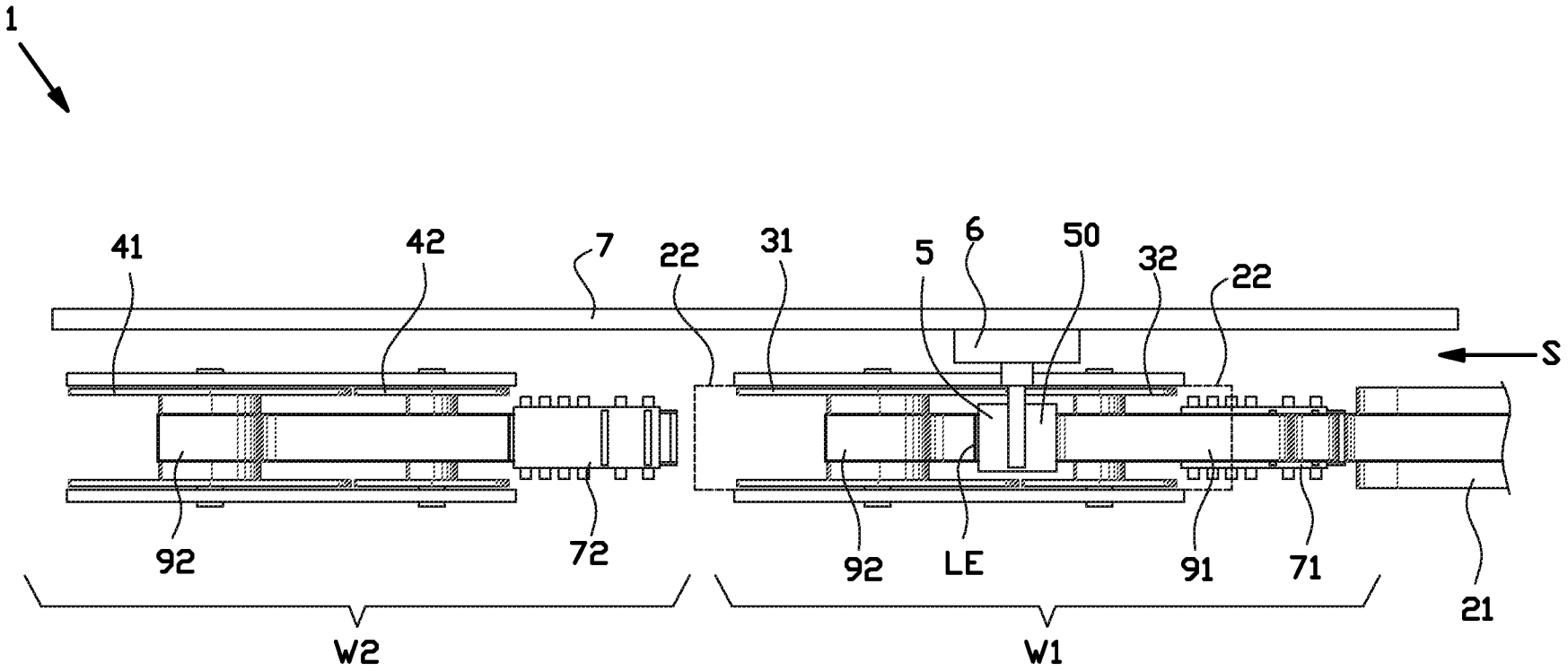
FIGS. 3 and 4 show top views of the wind-up system according to FIGS. 1 and 2, respectively.
Figure 4:
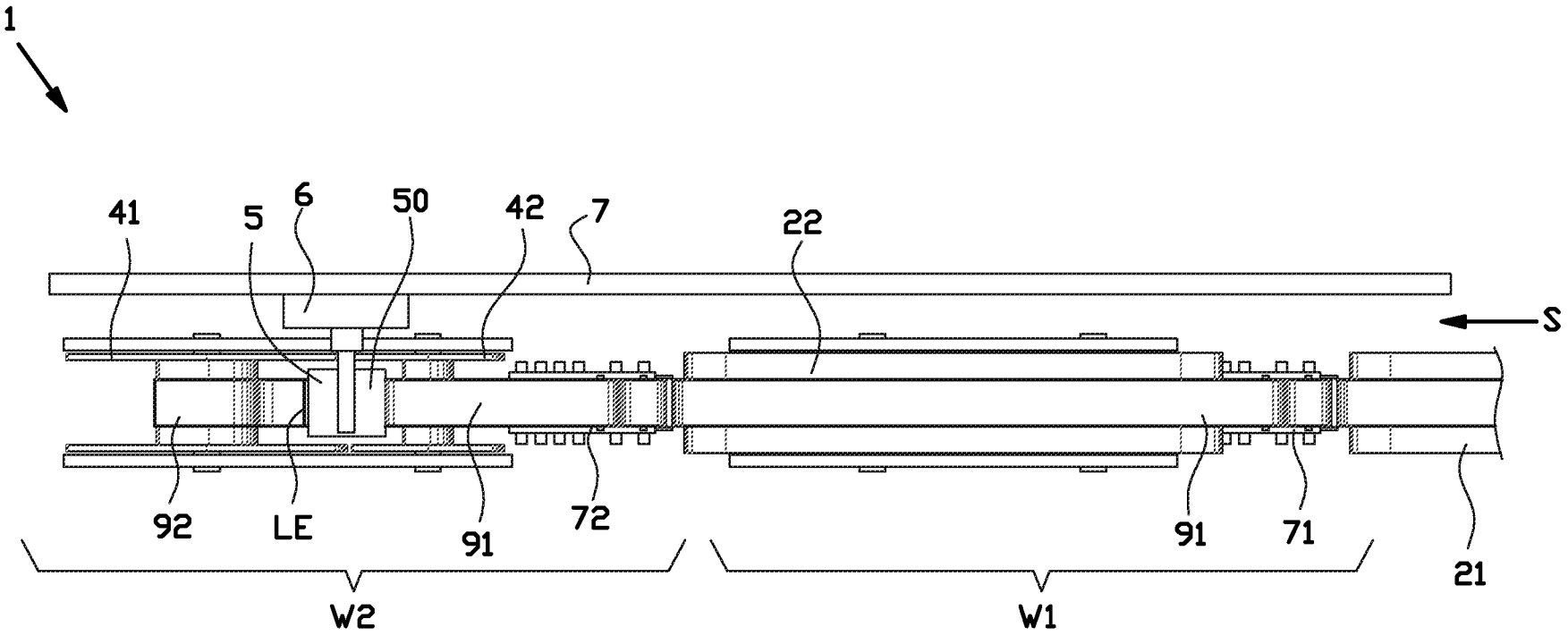
Figure 5:
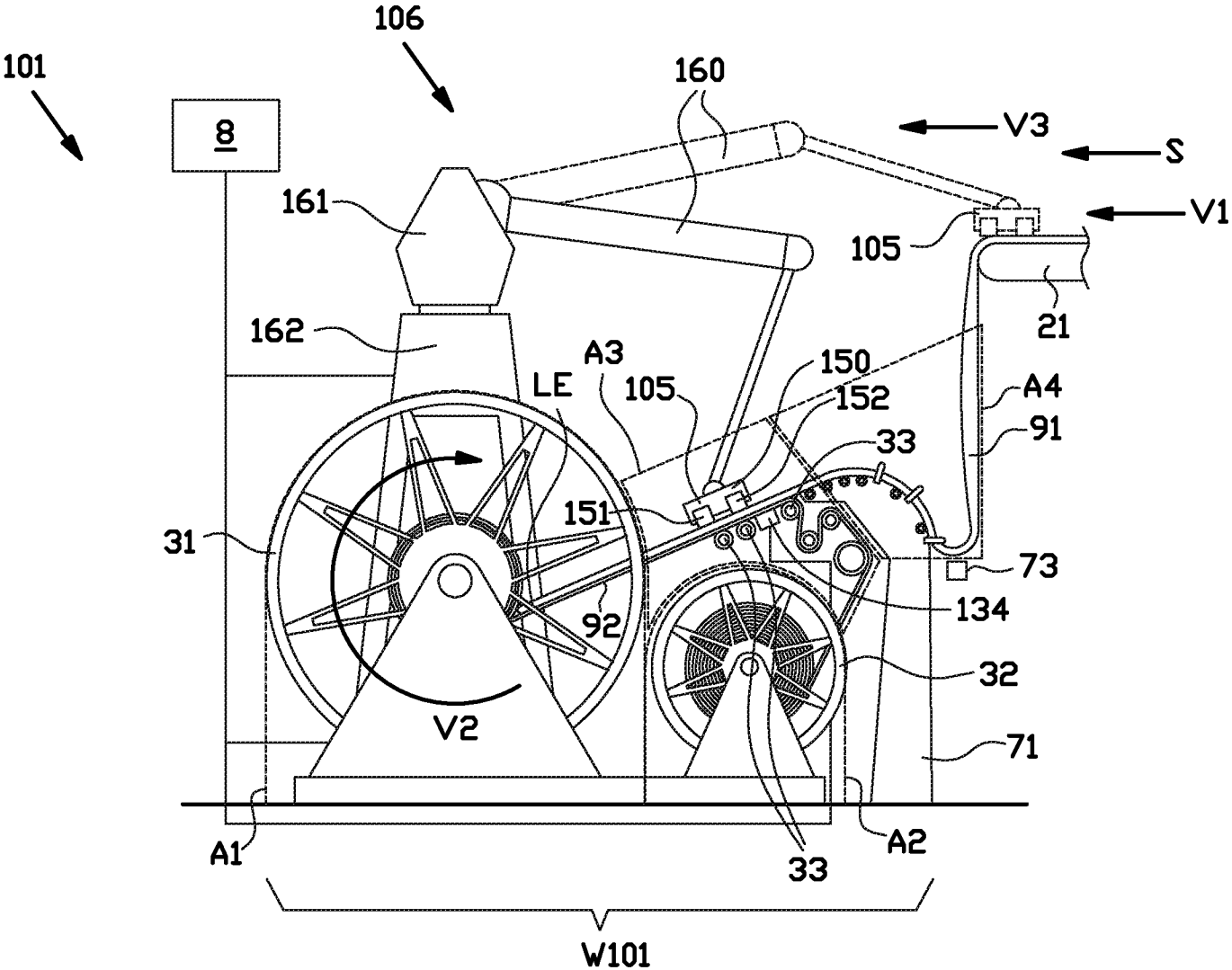
FIG. 5 shows a side view of an alternative wind-up system with a first work station and a second work station according to a second exemplary embodiment of the invention.
Figure 6:
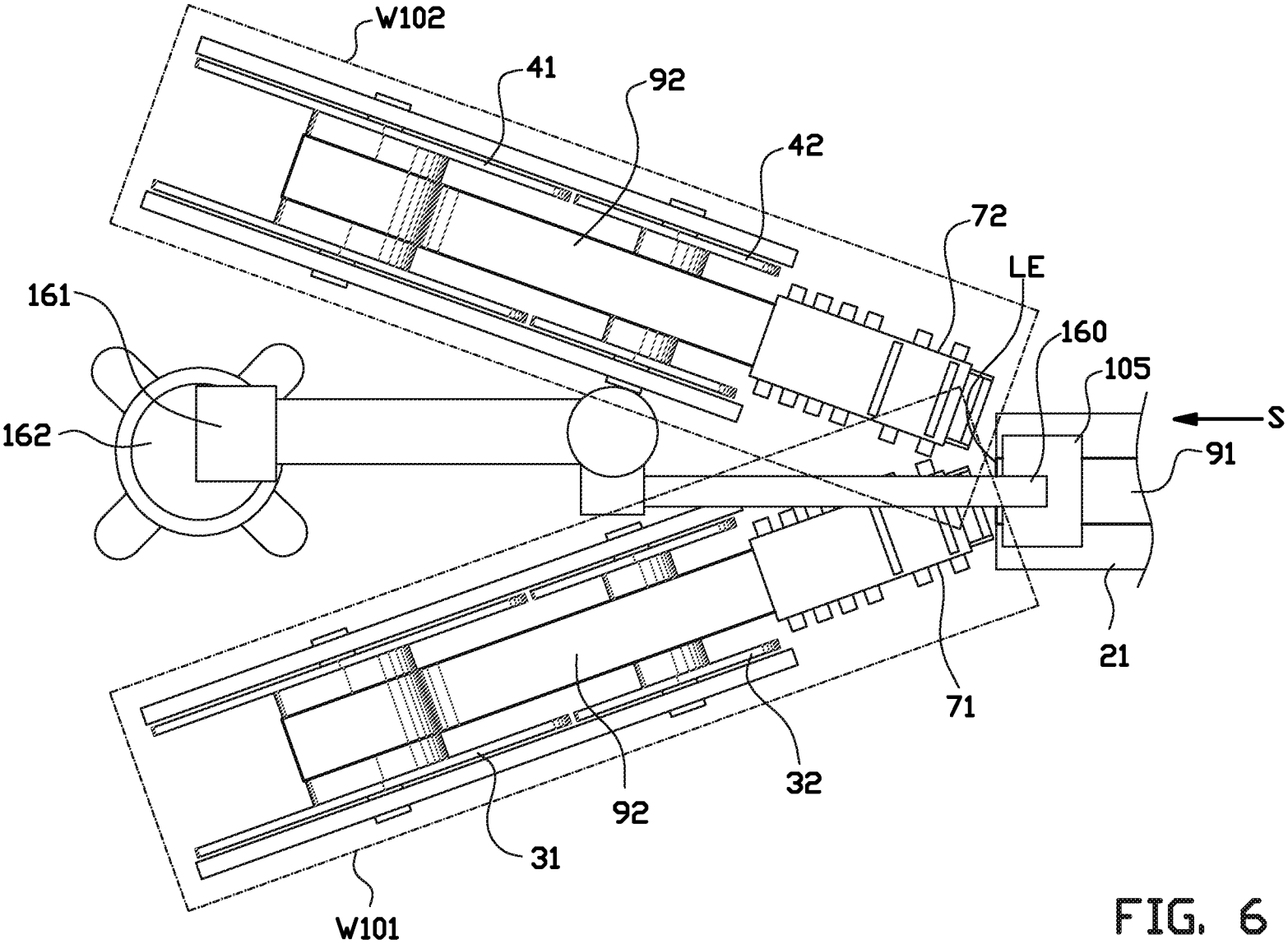
FIG. 6 shows a top view of the alternative wind-up system according to FIG. 5.
Figure 7:
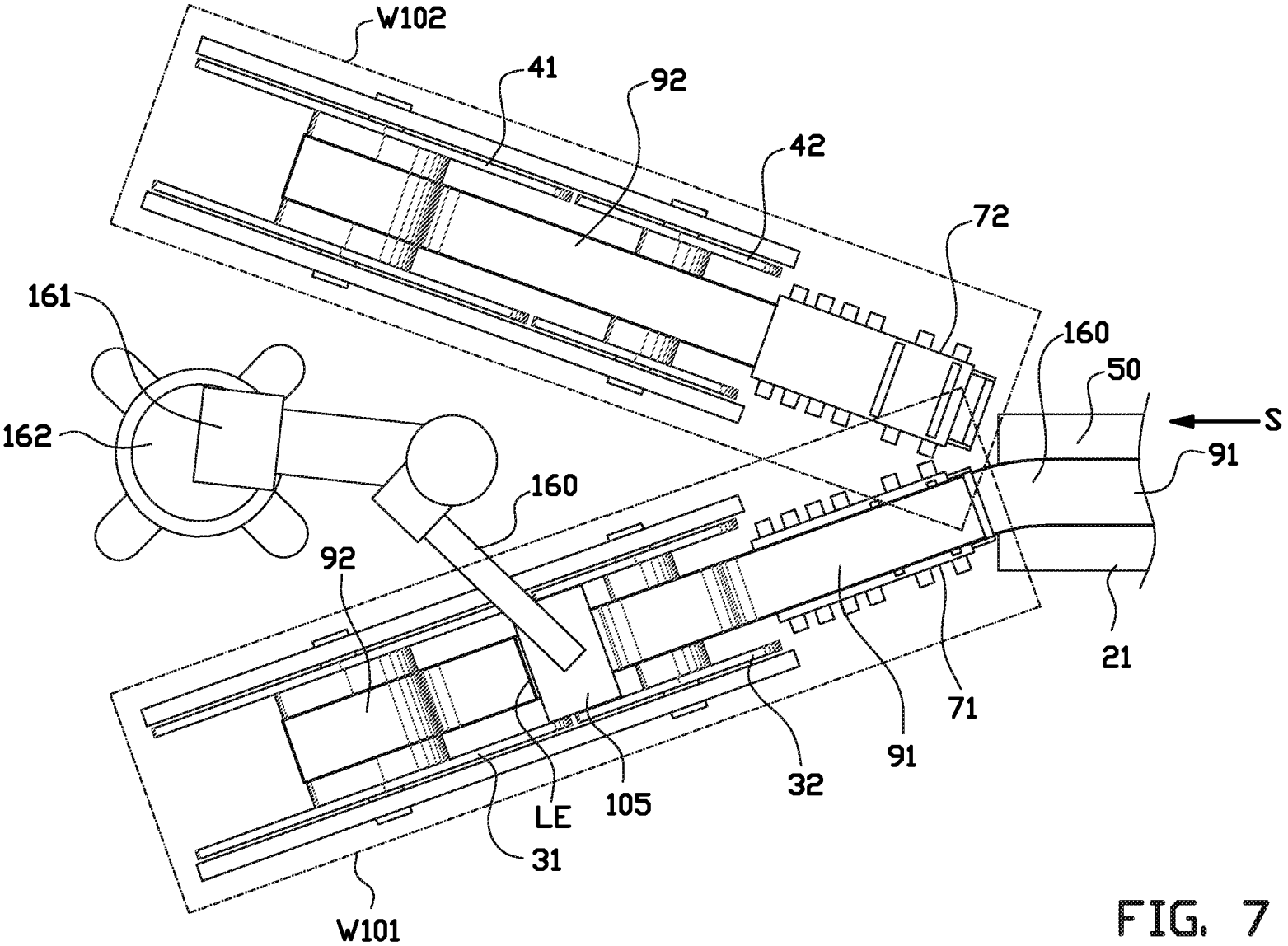
FIGS. 7 and 8 show top views of the alternative wind-up system according to FIG. 6 during the winding-up of a strip at the first work station and the second work station, respectively.

As shown in FIGS. 1 and 2, the wind-up system 1 comprises a first work station W1 and a second work station W2. The strip 91 can be alternately wound-up in each of said work stations W1, W2 to allow handling of a previously wound-up strip 91 in the inactive work station W1, W2. As best seen in FIGS. 3 and 4, the work stations W1, W2 according to this first embodiment of the invention are arranged in tandem or in-line.

In this exemplary embodiment, the wind-up system 1 comprises a first supply member 21 and a second supply member 22 for supplying the strip 91 to the first work station W1 and the second work station W2, respectively, in a supply direction S. As shown in FIGS. 1 and 3, the first supply member 21 is located above and directly upstream of the first work station W1 with respect to the supply direction S. As shown in FIGS. 2 and 4, the second supply member 22 is located overhead the first work station W1 and directly upstream of the second work station W2. In this example, both supply members 21, 22 are formed as transport conveyors for conveying the strip 91 along a linear path parallel to the supply direction S. The conveyors may be belt conveyors, roller conveyors or any other suitable type of conveyors. The supply members 21, 22 are arranged for supplying the strip 91 at a supply speed V1 towards the respective work stations W1, W2. In this first embodiment of the invention, the supply members 21, 22 are arranged in line with the tandem configuration of the work stations W1, W2, extending parallel to the supply direction S.

As shown in FIG. 1, the first work station W1 comprises a first collection area A1 for holding an empty first collection reel 31, a first liner area A2 for holding a loaded first liner reel 32 and a first guide area A3 between the first collection area A1 and the first liner area A2. The first liner reel 32 is arranged to unwind a length of service fabric or liner 92 through the first guide area A3 onto the first collection reel 31. The first part of the liner 92 is typically guided manually towards and into engagement with the first collection reel 31. To facilitate the guiding, the guide area A3 is provided with one or more first guide elements 33, e.g. in the form of rollers or pulleys. In FIG. 1, the first collection area A1, the first liner area A2 and the first guide area A3 are shown as distinct areas. However, it will be clear that the first guide area A3 is functionally defined as the area through which the liner 92 is guided from the first liner reel 32 up to the first collection reel 31. Hence, the first guide area A3 extends from the first liner area A2 into the first collection area A1. Preferably, the first guide area A3 extends from the core of the first liner reel 32 up to the core of the first collection reel 31. When the first collection reel 31 is provided with flanges, the first guide area A3 may at least partially extend between said flanges up to the core of the first collection reel 31.

The liner 92 is arranged to be interposed and/or placed between each winding of the strip 91 to prevent the windings of the strip 91 from sticking to each other. The strip 91 is arranged to be placed on top of the liner 92 in the first guide area A3 in order to move together with said liner 92 towards the first collection reel 31. As soon as the leading end LE of the strip 91 is fed into the nip between the liner 92 and the first collection reel 31 (or a previous winding of the liner 92 on said first collection reel 31), the leading end LE and the rest of the strip 91 is collected, pulled and/or wound-up onto the first collection reel 31 automatically. The first collection reel 31 is arranged to be rotated at a wind-up speed V2.

The first collection reel 31 and the first liner reel 32 may be separate elements within the first work station W1 which are individually replaceable. More commonly, the first collection reel 31 and the first liner reel 32 are formed as a cassette that can easily be inserted into and removed from the first work station W1.

The first work station W1 further comprises a first slacking area A4 for allowing a length of the strip 91 to slack between the first supply member 21 and the first guide area A3. The slacked portion of the strip 91 forms a buffer that can compensate for variations in the wind-up speed V2.

As shown in FIG. 2, the second work station W2 has the same areas as the first work station W1, each area having the same function. In short, the second work station W2 comprises a second collection area B1 for receiving a second collection reel 41, a second liner area B2 for receiving a second liner reel 42, a second guide area B3 with second guide elements 43 for guiding the liner 92 from the second liner reel 42 to the second collection reel 41 and a second slacking area B4 for buffering a length of the strip 91.

The wind-up system 1 further comprises a pick-and-place member 5 for picking-up a leading end LE of the strip 91 from the first supply member 21 at a pick-up position (shown in dashed lines in FIG. 1) and for placing the picked-up leading end LE of the strip 91 onto the liner 92 at a placement position within the first guide area A3 (shown in solid lines in FIG. 1). The pick-and-place member 5 comprises a head 50 and one or more retaining elements 51 for retaining the leading end LE of the strip 91 to the head 50. When the strip 91 comprises metal, the one or more retaining elements 51 may be formed as magnets. In this example, the pick-and-place member 5 comprises a first retaining element 51 in the form of a permanent magnet that can be moved with respect to the head 50 towards (see FIG.

10) and away (see FIG. 9) from the strip 91 to retain and release the strip 91, respectively. Alternatively, switchable electromagnets or vacuum means may be used.

In this first embodiment of the invention, the manipulator 6 is an XY-drive, e.g. an XY-gantry that is arranged for moving the pick-and-place member 5 with respect to the work stations W1, W2 in a horizontal direction, in this example parallel to the supply direction S, and a vertical direction.

As shown in FIG. 1, the pick-and-place member 5 according to the first embodiment of the invention comprises a feed-through member 53 for feeding the placed leading end LE of the strip 91 through from the placement position within the first guide area A3 towards and into contact with the first collection reel 31 at the first collection area A1. As shown in more detail in FIGS. 8 and 9, the feed-through member 53 is a feed-through conveyor, in particular a feed-through belt conveyor. Said feed-through member 53 defines a feed-through plane P and is arranged for feeding the strip 91 through in said feed-through plane P at a feed-through speed V3. The feed-through member 53 allows for feeding-through the strip 91 while the pick-and-place member 5 remains stationary, e.g. in the placement position. Hence, the strip 91 can be advanced towards and into engagement with the first collection reel 31 without the pick-and-place member 5 having to move towards the first collection reel 31.

The pick-and-place member 5 further comprises a deflection roller 55 that is located downstream of the feed-through member 53 with respect to the supply direction S. Said deflection roller 55 is rotatable with respect to the feed-through member 53 about a deflection axis X1 extending parallel to the feed-through plane P and perpendicular to the supply direction S. As such, the deflection roller 55 is positionable in a deflection position in which the deflection roller 55 at least partially intersects with the feed-through plane P for deflecting the strip 91 away from the feed-through plane P. This feature is used to deflect the strip 91 downwards from the first supply member 21 towards the first work station W1 in FIG. 1.

Figure 8:
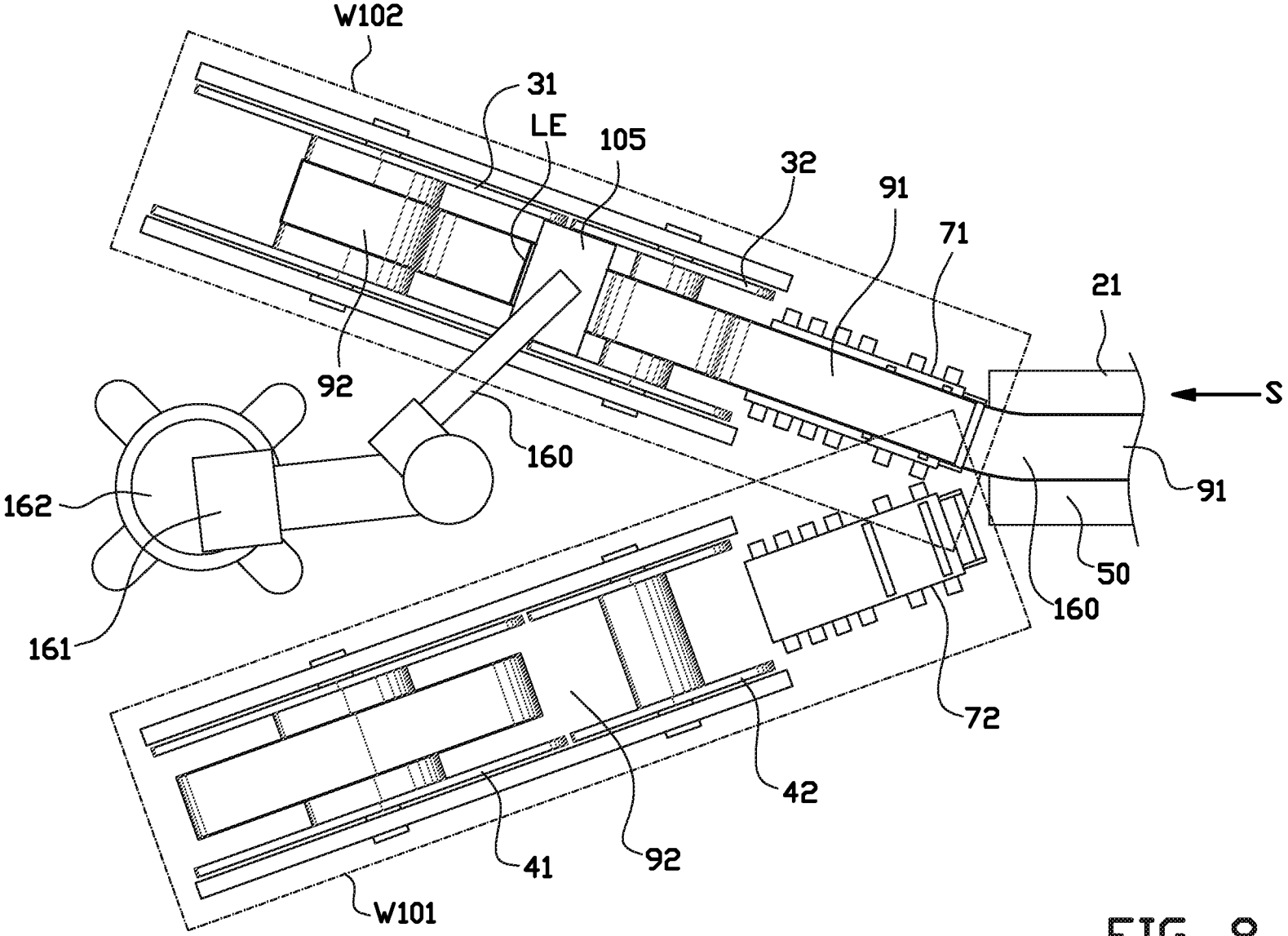
Figure 9:
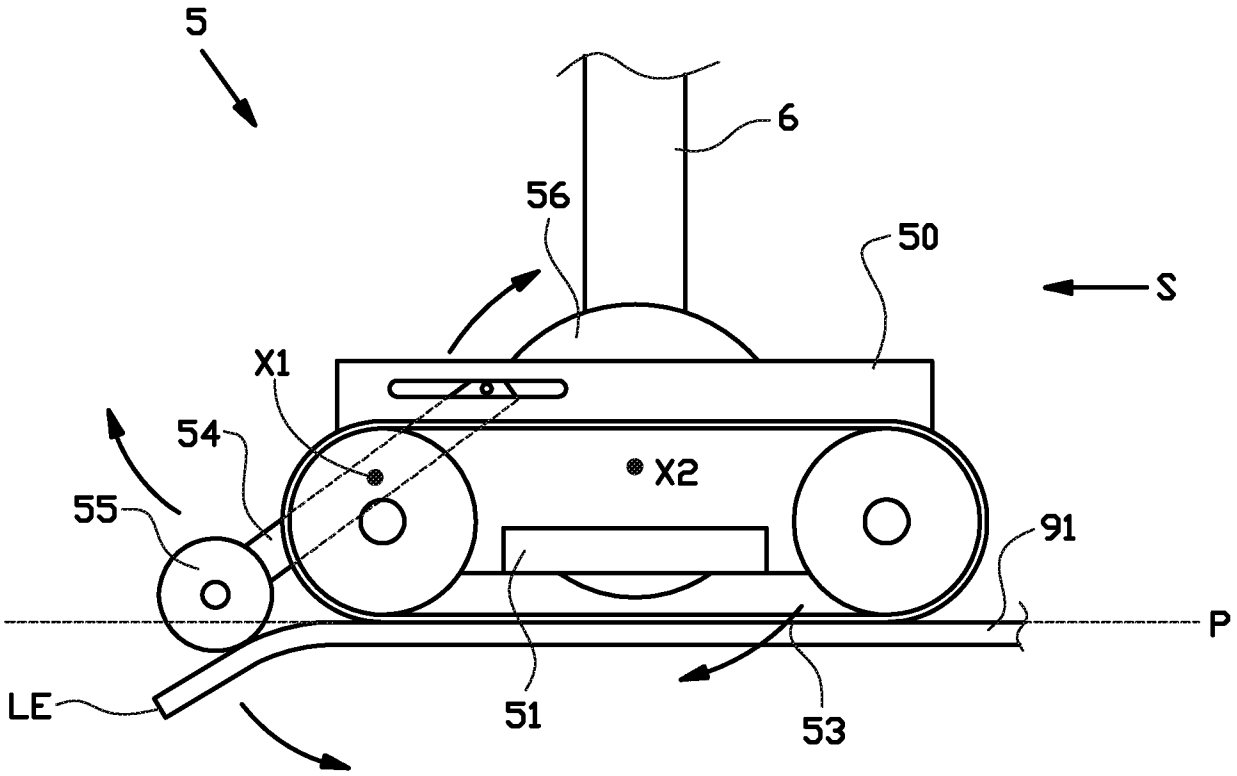
FIGS. 9 and 10 show side views of a pick-and-place member for use in the wind-up system according to FIGS. 1-4.

As shown in FIGS. 8 and 9, the pick-and-place member 5 is further provided with a tilt hinge 56 that is arranged for connecting the pick-and-place member 5 to the manipulator 6. The tilt hinge 56 allows for tilting of the pick-and-place member 5 with respect to the manipulator 6 about a tilt axis X2. Said tilt axis X2 extends parallel to the feed-through plane P and perpendicular to the supply direction S. Hence, the pick-and-place member 5 can be tilted to extend parallel to the strip 91 at the pick-up position (show in dashed lines in FIG. 1) and can be tilted to extend parallel to the unwound liner 92 at the placement position (shown in solid lines in FIG. 1). This allows for the feed-through member 53 to be in an optimal position for feeding-through of the strip 91.

As schematically shown in FIGS. 1 and 2, the wind-up system 1 comprises a control unit 8 that is operationally connected to the first supply member 21 and the second supply member 22 for controlling the supply speed V1. The control unit 8 is arranged for moving the pick-and-place member 5 at the same or substantially the same speed as the supply speed V1 in the supply direction S during the picking-up of the strip 91 in the pick-up position. Alternatively, the control unit 8 can be operationally connected to the feed-through member 53 for feeding the strip 91 through at a feed-through speed V3 in the supply direction S that is equal to the supply speed V1 when picking-up the strip 91 in the pick-up position. In both cases, the relative speed between the feed-through member 53 and the strip 91 is zero during the picking-up.

The control unit 8 is further arranged for detecting and/or controlling the wind-up speed V2 of the first collection reel 31. Hence, the control unit 8 can also adjust the feed-through speed V3 to match a wind-up speed V2 of the first collection reel 31 when feeding the strip 91 through from the placement position towards the first collection reel 31. Compression or stretching of the strip 91 can thus be prevented.

The control unit 8 is operationally connected to the pick-and-place member 5 for releasing the strip 91 from the pick-and-place member 5 when the leading end LE has been engaged by the first collection reel 31. In this example, the release is obtained by moving the permanent magnet retaining member 51 sufficiently away from the strip 91.

As shown in FIG. 1, when the leading end LE of the strip 91 is placed onto and/or in abutting contact with the liner 92 at the placement position, the portion of the strip 91 downstream of said leading end LE is allowed to slack or form a loop in the first slacking area A4. To guide the slacking portion of the strip 91, the first work station W1 is provided with a slacking guide 71 that is arranged to support the strip 91 in at least a part of the portion of the strip 91 that is slacking, preferably to guide the strip 91 onto the liner 92 towards the placement position. The wind-up system 1 is provided with a first sensor 73 in the first slacking area A4 for detecting the amount of slacking of the strip 91. The control unit 8 is arranged for adjusting the feed-through speed V3 at the feed-through member 53 to a speed that is lower than the supply speed V1 at the moment that the strip 91 is placed onto and/or in abutting contact with the liner 92. As the first supply member 21 continues to feed the strip 91 to the first work station W1, the strip 91 starts to slack. The feed-through speed V3 is then adjusted to match the wind-up speed V2 of the first collection reel 31 as soon as a threshold amount of slacking is detected.

The second slacking area B4 in the second work station W2 comprises a similar slacking guide 72 and a second sensor 74 for detecting the slacking in said second slacking area B4.

A method for winding-up the strip 91 using the wind-up system 1 according to the first embodiment of the invention will be elucidated briefly below with reference to FIGS. 1-4.

As shown in FIG. 1 in dashed lines, the strip 91 has a leading end LE, either at the start of the process or as a result of cutting of a previously wound-up part of the continuous strip 91, which is supported on the first supply member 21. The liner 92 at the first work station W1 is unwound from the first liner reel 32 at the first liner area A2 and guided through the first guide area A3 onto the first collection reel 31 at the first collection area A1. The pick-and-place member 5 is arranged for picking up the leading end LE from a pick-up position on the first supply member 21 as the strip 91 is being fed by the first supply member 21 in the supply direction S. The feed-through member 53 is driven at a feed-through speed V3 that is equal to the supply speed V1. As soon as the pick-and-place member 5 has picked-up the leading end LE, e.g. through magnetic attraction of the retaining element 51, the XY-drive of the manipulator 6 moves the pick-and-place member sideways and downwards towards the placement position on the liner 92, as shown in solid lines in FIG. 1. The motion may take place in the X and Y direction separately or as a combined motion.

The pick-and-place member 5 is arranged for placing the picked-up leading end LE onto and/or in abutting contact with the liner 92 at the placement position within the first guide area A3 without letting go of said leading end LE. As previously described, the feed-through speed V3 may be kept at zero to buffer a length of the strip 91 in the first slacking area A4. When a sufficient length of the strip 91 has been buffered, the feed-through speed V3 is increased to match the wind-up speed V2 of the first collection reel 31 and the leading end LE is fed into the nip between the liner 92 and the first collection reel 31 (or previous winding of the liner 92 on said first collection reel 31. When the leading end LE is engaged by and/or spooled onto the first collection reel 31, the strip 91 is released from the pick-and-place member 5. The pick-and-place member 5 may now return to the first supply member 21 to wait for a next cycle of the method.

The next cycle of the method can be performed at the second work station W2 while the full first collection reel 31 at the first work station W1 is being replaced, as shown in FIGS. 2 and 4. To switch to the second work station W2, the strip 91 that is being wound on the first collection reel 31 has to be cut-off. This cutting can for example take place on the first supply member 21. After the cutting, the remainder of the strip 91 and the trailing end thereof are wound onto the first collection reel 31. The winding at the first work station W1 is then completed. The newly created leading end LE at the first supply member 21 can subsequently be picked-up by the pick-and-place member in substantially the same manner as in the previously described cycle of the method. However, instead of moving down after the first supply member 21, the XY-drive of the manipulator 6 is arranged for moving the pick-and-place member 5 towards and over the second supply member 22 to bypass the first work station W1, as shown in dashed lines in FIG. 2. The pick-and-place member 5 can subsequently be moved downwards downstream of the second supply member 22 to place the leading end LE onto the unwound liner 92 at the second work station W2 in substantially the same manner as in the previously described cycle of the method. Now the previously described steps of the cycle can be repeated to wind-up the strip 91 onto the second collection reel 32 at the second work station W2.

FIGS. 5-8 show an alternative wind-up system 101 for winding-up a strip 91 according to a second exemplary embodiment of the invention. Said alternative wind-up system 101 differs from the previously discussed wind-up system 1 in that its work stations W101, W102 are arranged side-by-side in a direction transverse to the supply direction S. More in particular, both work stations W101, W102 are arranged at an oblique angle with respect to said supply direction S to form a Y-shaped or V-shaped configuration together with a single supply member 21. Because of the side-by-side configuration, there is no need for a second supply member as in FIGS. 1-4 because there is no need to bypass the first work station W101. One can simply alternate between the work stations W101, W102 by changing the direction of the strip 91 from the supply direction S into alignment with one of the work stations W101, W102.

To alternate between the work stations W101, W102, the alternative wind-up system 101 is further provided with an alternative pick-and-place member 105 and an alternative manipulator 106 to move said alternative pick-and-place member 105 between the work stations W101, W102. In this exemplary embodiment, the alternative manipulator 106 comprises a robotic arm, preferably with at least four degrees of freedom, e.g. two translations and two rotations. Hence, said alternative manipulator 106 is able to cause complex motions of the pick-and-place member 105 with respect to the supply member 21 and the work stations W101, W102. In this exemplary embodiment, the robotic arm 160 comprises a plurality of articulating segments and is supported on a rotatable base 161 that is rotatable with respect to a fixed base 162.

The previously described control unit 8 can now be operationally connected to the alternative manipulator 106 for moving the alternative pick-and-place member 105 at a pick-up speed V3 in the supply direction S that is equal to the supply speed V1 of the supply member 21 when picking-up the strip 91 in the pick-up position. The degrees of freedom of the alternative manipulator 106 allow for the motion of the alternative pick-and-place member 105 to accurately follow the strip 91 during the picking-up of the leading end LE. Consequently, the alternative pick-and-place member 105 does not require a feed-through means incorporated therein, as the alternative pick-and-place member 105 as a whole is able to move together with the strip 91 during picking-up and/or placement. Therefore, the alternative pick-and-place member 105 only features a head 150 and one or more retaining elements 151, 152, in this example in the form of magnets, to retain the strip 91 to the head 150. Preferably the magnets 151, 152 are switchable electromagnets to facilitate instant and/or controlled retaining and release.

However, after placement, the alternative manipulator 106 may not be able to retain the strip 91 on the inner liner 92 up to the moment that the leading end LE has been engaged by and/or spooled onto the collection reel 31, 41 at one of the work stations W101, W102. Hence, instead of having a feed-through means at the alternative pick-and-place member 105, the alternative wind-up system 101 features a feed-through retainer 134 for retaining the strip 91 to the liner 92 during feeding-through of said strip (91) towards the first collection reel (31). In this exemplary embodiment, the feed-through retainer 134 is a magnet that is arranged to be located below the unwound liner 92 at or near the placement position. The feed-through retainer 134 may be a switchable electromagnet to facilitate instant and/or controlled retaining and release. Alternative, the feed-through retainer 134 comprises a permanent magnet that is movable towards and away from the liner 92. Preferably, the position of the feed-through retainer 134 is offset with respect to the one or more retaining elements 151, 152 to prevent interference between the magnetic fields of the magnets of the retaining elements 151, 152 and the magnet of the feed-through retainer 134.

The magnetic attraction generated by the feed-through retainer 134 is strong enough to retain the strip 91 to the liner 92, while allowing the laminate of the liner 92 and the strip 91 supported thereon to advance towards the collection reel 31, 41 of the respective work station W101, W102. The previously described control unit 8 may be operationally connected to the feed-through retainer 134 for releasing the strip 91 from the feed-through retainer 134 when the leading end LE has been engaged by and/or spooled onto the first collection reel 31.

Hence, in an alternative method for winding-up the strip 91 with the use of the aforementioned alternative wind-up system 101, the steps of winding-up would comprise:

unwinding the liner 92 from the first liner reel 32 at the first liner area A2 through the first guide area A3 onto the first collection reel 31 at the first collection area A1;

using the alternative pick-and-place member 105 to pick-up a leading end LE of the strip 91 from the first supply member 21 at a pick-up position and to place the picked-up leading end LE of the strip 91 onto and/or in abutting contact with the liner 92 at a placement position within the first guide area A3;

using the feed-through retainer 134 to take-over the placed strip 91 from the alternative pick-and-place member 105 and switching off the retaining elements 151, 152 of the alternative pick-and-place member 105 when the feed-through retainer 134 has taken over the strip 91;

feeding the strip 91 through towards the first collection reel 31 by further unwinding the inner liner 92 and releasing the strip 91 from the feed-through retainer 134 as soon as the leading end LE has been engaged by and/or spooled onto the first collection reel 31.

When switching from the first work station W101 to the second work station W102, the strip 91 is cut-off and the new leading end LE is created. For cutting, the alternative pick-and-place member 105 may be provided with a cutting means, e.g. a heated cutter. The new leading end LE is picked-up by the alternative pick-and-place member 105 and moved by the alternative manipulator 106 towards and onto and/or in abutting contact with the liner 92 at the second work station W102. Hence, the alternative manipulator 106 is alternately movable from the supply member 21 to the first work station W101 and the second work station W102 by rotating the robotic arm 160 with respect to its fixed base 162 into alignment with the first work station W101 and the second work station W102, respectively.

It is to be understood that the above description is included to illustrate the operation of the preferred embodiments and is not meant to limit the scope of the invention. From the above discussion, many variations will be apparent to one skilled in the art that would yet be encompassed by the scope of the present invention.

For example, it will be clear to one skilled in the art that the robotic arm of the alternative manipulator 106 may alternatively be used to pick-up, transfer and place the strip 91 in the wind-up system 1 according to the first embodiment of the invention, provided that the alternative manipulator 106 is movable over a range that can service both work stations W1, W2. In yet another alternative embodiment, two alternative manipulators 106 according to the second embodiment of the invention may be used in the wind-up system 1 according to the first embodiment of the invention, e.g. one alternative manipulator 106 at each station W1, W2.

Figure 10:
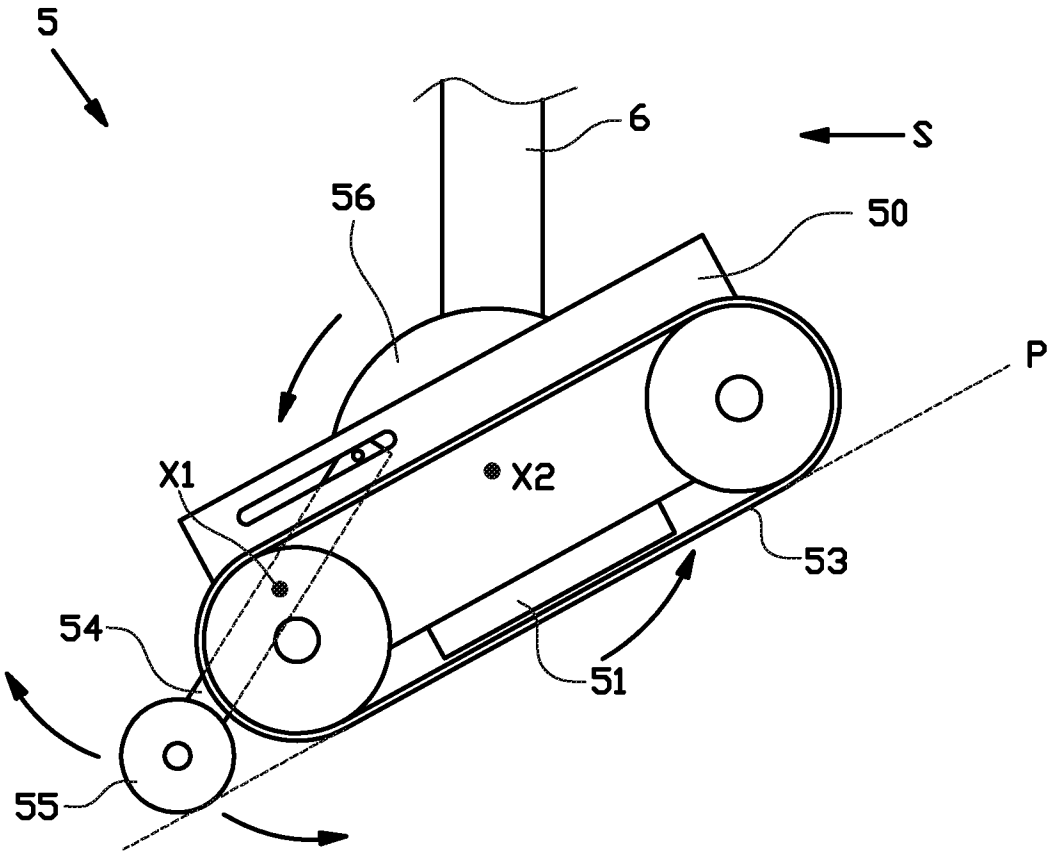
Figure 11:
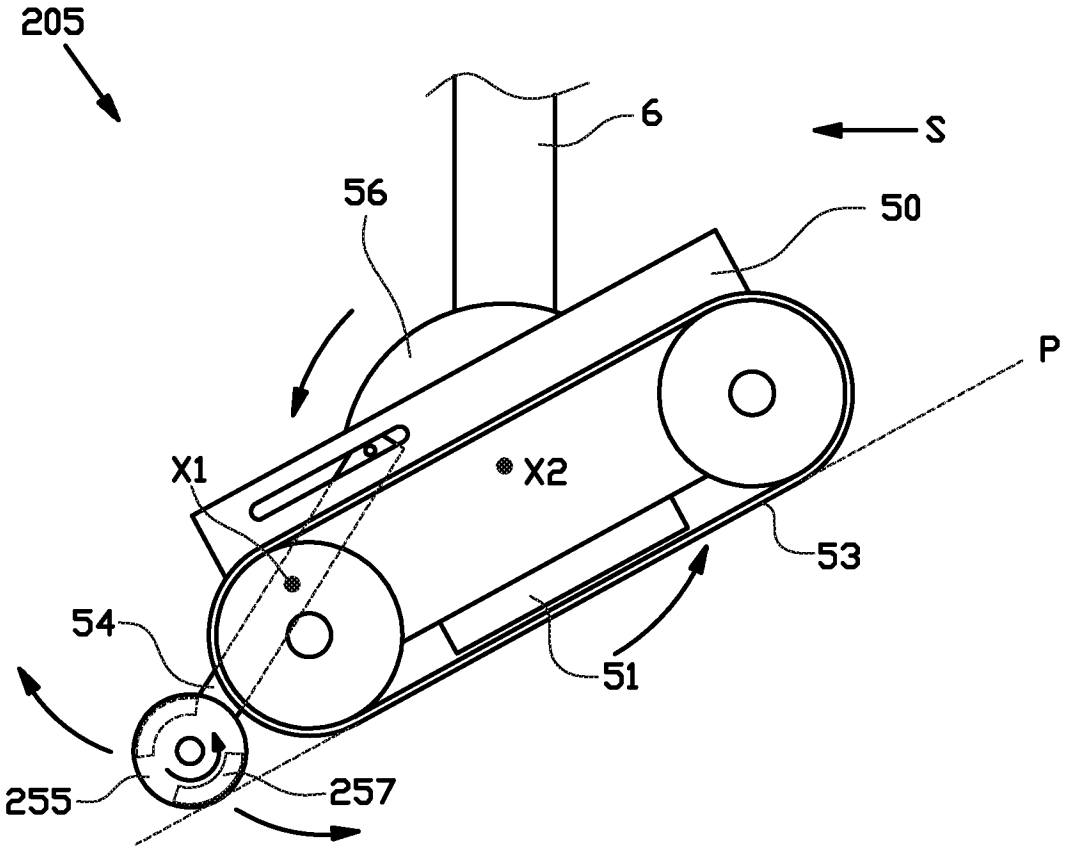
FIG. 11 shows a side view of a further alternative pick-and-place member according to a third exemplary embodiment of the invention for use in the wind-up system according to FIGS. 1-4.

FIG. 11 shows a further alternative pick-and-place member 205 according to a third embodiment of the invention. The alternative pick-and-place member 205 differs from the previously discussed pick-and-place member as shown in FIGS. 9 and 10 in that it is provided with an additional retaining element 257 at the deflection roller 255. In particular, said additional retaining element 257 is arranged at or inside the deflection roller 255 to retain the strip to the deflection roller 255. Hence, the retaining element 257 at or in the deflection roller 255 can cooperate with the one or more retaining elements 51 at the head 50 to securely retain the strip. This is particularly useful when the strip has a relatively long leading end, in which case said leading end can be retained more reliably. In this particular example, the additional retaining element 257 is a magnet, preferably a permanent magnet. Alternatively, the additional retaining element 257 may be a vacuum element. Preferably, the magnet is located inside the deflection roller 255 with the deflection roller 255 being rotatable independently from the internal magnet. More preferably, the deflection roller 255 is freely rotatable about a central shaft and the magnet is connected to the central shaft so as to rotate together with said central shaft from an active position to an inactive position, as shown in dashed lines in FIG. 11, away from the strip at the feed-through plane P.

Figure 12:
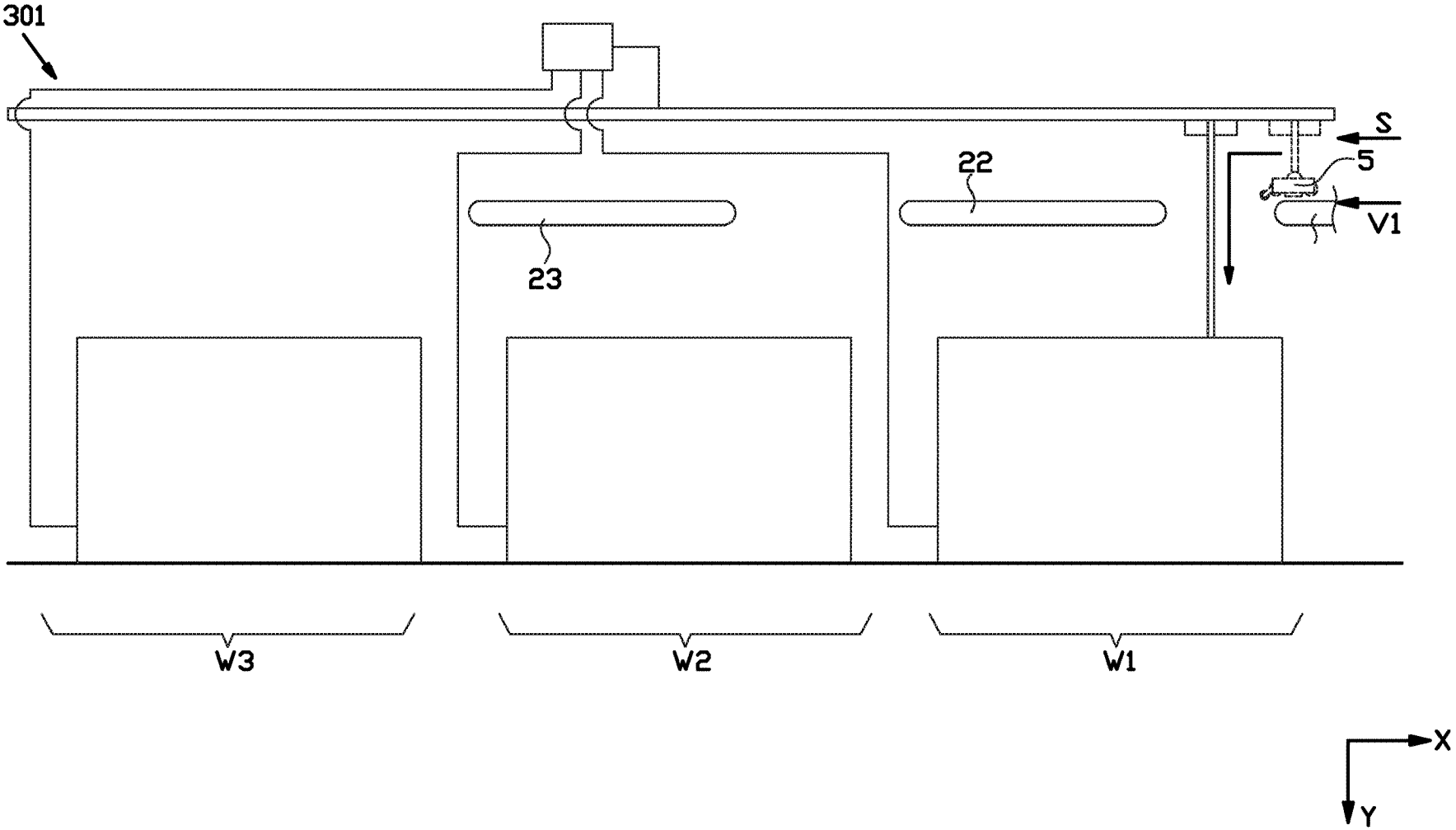
FIG. 12 shows a side view of a further alternative wind-up system according to a fourth exemplary embodiment of the invention.

FIG. 12 shows a further alternative wind-up system 301 according to a fourth embodiment of the invention in which a third work station W3 is added together with a third supply member 23 overhead the second work station W2 to bypass said second work station W2. Further stations may be added in a similar manner. The third work station W3 may for example be a station for collecting scrap or a station for collecting different strips or tire components.

The invention claimed is:

1. A wind-up system for winding-up a strip, wherein the wind-up system comprises a first work station and a first supply member for supplying the strip to said first work station in a supply direction, wherein the first work station comprises:

a first collection area for holding a first collection reel that is arranged to collect and wind-up the strip over a plurality of windings;

a first liner area for holding a first liner reel that is arranged to unwind a liner; and a first guide area extending from the first liner area into the first collection area, wherein the unwound liner is arranged to be unwound from the first liner reel at the first liner area through the first guide area onto the first collection reel at the first collection area;

wherein the wind-up system further comprises a pick-and-place member for picking-up a leading end of the strip from the first supply member at a pick-up position and for placing the picked-up leading end of the strip onto the liner at a placement position within the first guide area.

2. The wind-up system according to claim 1, wherein the wind-up system comprises a manipulator for moving the pick-and-place member from the pick-up position above the first supply member into the placement position at the unwound liner within the first guide area.

3. The wind-up system according to claim 2, wherein the pick-and-place member comprises a head and one or more retaining elements for retaining the leading end of the strip to the head from the moment it has been picked-up at least until the leading end of the strip has been placed onto the liner.

4. The wind-up system according to claim 3, wherein the strip comprises metal, wherein the one or more retaining elements comprises at least one magnet.

5. The wind-up system according to claim 3, wherein the one or more retaining elements comprises at least one vacuum element.

6. The wind-up system according to claim 2, wherein the manipulator is an XY-drive.

7. The wind-up system according to claim 2, wherein the pick-and-place member is provided with a tilt hinge that is arranged for connecting the pick-and-place member to the manipulator such that the pick-and-place member is tiltable with respect to the manipulator about a tilt axis to extend parallel to the strip at the pick-up position and parallel to the unwound liner at the placement position.

8. The wind-up system according to claim 2, wherein the manipulator comprises a robotic arm.

9. The wind-up system according to claim 8, wherein the manipulator has at least four degrees of freedom.

10. The wind-up system according to claim 8, wherein the wind-up system comprises a control unit that is operationally connected to the first supply member for controlling the supply speed of the first supply member, wherein the control unit is further operationally connected to the manipulator for moving the pick-and-place member at a pick-up speed in the supply direction that is equal to the supply speed when picking-up the strip in the pick-up position.

11. The wind-up system according to claim 10, wherein the first work station is provided with a feed-through retainer for retaining the strip to the liner during feeding-through of said strip towards the first collection reel, wherein the control unit is operationally connected to the feed-through retainer for releasing the strip from the feed-through retainer when the leading end has been engaged by the first collection reel.

12. The wind-up system according to claim 8, wherein the first work station is provided with a feed-through retainer for retaining the strip to the liner during feeding-through of said strip towards the first collection reel.

13. The wind-up system according to claim 12, wherein the strip comprises metal, wherein the feed-through retainer is a magnet that is arranged to be located below the unwound liner at or near the placement position.

14. The wind-up system according to claim 13, wherein the pick-and-place member comprises a head and one or more retaining elements for retaining the leading end of the strip to the head at least until the leading end of the strip has been placed onto the liner, wherein the one or more retaining elements comprises at least one magnet, wherein the position of the feed-through retainer is offset with respect to the one or more retaining elements.

15. The wind-up system according to claim 1, wherein the pick-and-place member comprises a feed-through member for feeding the placed leading end of the strip through from the placement position within the first guide area towards and into contact with the first collection reel at the first collection area.

16. The wind-up system according to claim 15, wherein the feed-through member is a feed-through conveyor.

17. The wind-up system according to claim 15, wherein the feed-through member defines a feed-through plane and is arranged for feeding the strip through in said feed-through plane, wherein the pick-and-place member comprises a deflection roller that is located downstream of the feed-through member with respect to the supply direction, wherein the deflection roller is rotatable with respect to the feed-through member about a deflection axis extending parallel to the feed-through plane and perpendicular to the supply direction, wherein the deflection roller is positionable in a deflection position in which the deflection roller at least partially intersects with the feed-through plane for deflecting the strip away from the feed-through plane.

18. The wind-up system according to claim 17, wherein the pick-and-place member comprises an additional retaining element at or in the deflection roller.

19. The wind-up system according to claim 15, wherein the wind-up system comprises a control unit that is operationally connected to the first supply member for controlling the supply speed of the first supply member, wherein the control unit is further operationally connected to the feed-through member for feeding the strip through at a feed-through speed in the supply direction that is equal to the supply speed when picking-up the strip in the pick-up position.

20. The wind-up system according to claim 19, wherein the control unit is arranged for adjusting the feed-through speed to match a wind-up speed of the first collection reel when feeding the strip through from the placement position towards the first collection reel.

21. The wind-up system according to claim 19, wherein the first workstation comprises a first slacking area extending between the first supply member and the first guide area for guiding a slacking portion of the strip from the first supply member towards the first guide area, wherein the wind-up system is provided with a first sensor in said first slacking area for detecting the amount of slacking of the strip, wherein the control unit is arranged for lowering the feed-through speed to a speed that is lower than the supply speed at the moment that the strip is placed onto the liner and for adjusting the feed-through speed to match the wind-up speed of the first collection reel when a threshold amount of slacking is detected.

22. The wind-up system according to claim 19, wherein the control unit is operationally connected to the pick-and-place member for releasing the strip from the pick-and-place member when the leading end has been engaged by the first collection reel.

23. The wind-up system according to claim 1, wherein the wind-up system further comprises a second work station, wherein the second work station comprises:

a second collection area for holding a second collection reel that is arranged to collect and wind-up the strip over a plurality of windings;

a second liner area for holding a second liner reel that is arranged to unwind a liner; and a second guide area extending from the second liner area into the second collection area, wherein the unwound liner is arranged to be unwound from the second liner reel at the second liner area through the second guide area onto the second collection reel at the second collection area, wherein the pick-and-place member is arranged for picking-up the leading end of the strip from the first supply member at a pick-up position and for alternately placing the picked-up leading end of the strip onto the liner at a placement position within the first guide area of the first work station and at a placement position within the second guide area of the second work station.

24. The wind-up system according to claim 23, wherein the first work station and the second work station are arranged in tandem in the supply direction.

25. The wind-up system according to claim 24, wherein the wind-up system comprises a second supply member extending in-line with the first supply member above the first work station for receiving and guiding the strip over said first work station when the picked-up leading end of the strip is placed at a placement position within the second guide area of the second work station.

26. The wind-up system according to claim 23, wherein the first work station and the second work station are arranged side-by-side in a direction transverse to the supply direction.

27. The wind-up system according to claim 26, wherein the first work station, the second work station or both are at an oblique angle with respect to the supply direction.

28. The wind-up system according to claim 23, wherein the wind-up system further comprises a third work station or further work stations.

29. A method for winding-up a strip with the use of the wind-up system according to claim 1, wherein the method comprises the steps of:

unwinding the liner from the first liner reel at the first liner area through the first guide area onto the first collection reel at the first collection area;

using the pick-and-place member to pick-up a leading end of the strip from the first supply member at a pick-up position and to place the picked-up leading end of the strip onto the liner at a placement position within the first guide area.

30. The method according to claim 29, wherein the leading end of the strip is retained by the pick-and-place member from the moment it has been picked-up at least until the leading end of the strip has been placed onto the liner.

31. The method according to claim 29, wherein the strip is fed-through from the placement position towards the first collection reel at a feed-through speed, wherein the first workstation comprises a first slacking area extending between the first supply member and the first guide area for guiding a slacking portion of the strip from the first supply member towards the first guide area, wherein the feed-through speed is lower than the supply speed at the moment that the strip is placed onto the liner and is adjusted to match the wind-up speed of the first collection reel when a threshold amount of slacking is detected.

32. The method according to claim 31, wherein the strip is released from the pick-and-place member when the leading end has been engaged by the first collection reel.

33. The method according to claim 29, wherein the strip is retained to the liner by a feed-through retainer during feeding-through of said strip towards the first collection reel.

34. The method according to claim 33, wherein the strip is released from the feed-through retainer when the leading end has been engaged by the first collection reel.

35. The method according to claim 29, wherein the wind-up system further comprises a second work station, wherein the second work station comprises:

a second collection area for holding a second collection reel that is arranged to collect and wind-up the strip over a plurality of windings;

a second liner area for holding a second liner reel that is arranged to unwind a liner; and a second guide area extending from the second liner area into the second collection area, wherein the unwound liner is arranged to be unwound from the second liner reel at the second liner area through the second guide area onto the second collection reel at the second collection area, wherein the pick-and-place member picks-up the leading end of the strip from the first supply member at a pick-up position and alternately places the picked-up leading end of the strip onto the liner at a placement position within the first guide area of the first work station and at a placement position within the second guide area of the second work station.

* * * * *